United States Patent [19]

Mathna et al.

[11] Patent Number: 4,729,518

[45] Date of Patent: Mar. 8, 1988

[54] TAPE DISPENSER INCLUDING A BACKCARD WITH PROJECTING HUB PARKING PORTIONS

[75] Inventors: Charles A. Mathna, St. Paul; Susan M. Butzer, Eagan, both of Minn.

[73] Assignee: Minnesota Mining and Manufacturing Company, St. Paul, Minn.

[21] Appl. No.: 900,701

[22] Filed: Aug. 27, 1986

[51] Int. Cl.[4] ..... B65H 19/00; B65H 35/10

[52] U.S. Cl. ..... 242/55.53; 225/78; 156/527

[58] Field of Search ..... 242/55.53, 75.4, 99, 242/55.2; 225/45, 46, 51, 78, 82; 206/409, 411; 156/527, 577

[56] References Cited

U.S. PATENT DOCUMENTS

| | | | |
|---|---|---|---|
| 3,086,309 | 4/1963 | Katz | 242/55.53 |
| 3,263,805 | 8/1966 | Hollins | 242/55.53 |
| 4,244,503 | 1/1981 | Kramer | 225/46 |
| 4,271,962 | 6/1981 | Stepanski | 242/55.53 |
| 4,616,469 | 10/1986 | Skalleberg | 206/409 |

*Primary Examiner*—John M. Jillions
*Assistant Examiner*—Steven M. duBois
*Attorney, Agent, or Firm*—Donald M. Sell; James A. Smith; William L. Huebsch

[57] ABSTRACT

A tape dispenser comprising a housing including a hub, a roll of tape journaled on the hub and a length of low tack pressure sensitive adhesive coated tape wound around the core. A paper backcard disposed around one end of the hub includes a plurality of generally triangular projecting portions projecting between the hub and the core to provide a friction brake therebetween restricting rotation of said hub to an extent that will prevent unwanted rotation of the hub and uncoiling of the tape when it is withdrawn from the dispenser.

4 Claims, 4 Drawing Figures

TAPE DISPENSER INCLUDING A BACKCARD WITH PROJECTING HUB PARKING PORTIONS

TECHNICAL FIELD

The present invention relates to hand held tape dispensers for relatively low tack pressure sensitive adhesive coated tape from which the tape is manually withdrawn.

BACKGROUND ART

Many dispensers are known which comprise a housing including a hub having a cylindrical peripheral surface, a roll of tape comprising a core having a through opening defined by a cylindrical inner surface journaled on the hub and a length of tape including a layer of pressure sensitive adhesive wound around the core; and a paper backcard having a through opening and disposed around one end of the hub with the hub in the opening and at least a main portion of the backcard adjacent one side surface of the roll of tape.

Problems have been encountered when such a tape dispenser is used to dispense a tape including a layer of pressure sensitive adhesive which affords low adhesion between adjacent wraps of the tape in a roll and to a land area adjacent a cutter on the dispenser, to which land area the layer of adhesive is intended to be adhered before the tape is cut by pulling it into engagement with the cutter (e.g., the tape sold under the trade designation Cat. 658 "Post-it" TM Cover-Up Tape by Minnesota Mining and Manufacturing Company, St. Paul, Minn.). When such a tape is withdrawn from a conventional dispenser in which the hub is freely rotatable, the outer wrap of the tape tends to easily uncoil so that often as a person attempts to pull the tape into engagement with the land area and cutter, the tape will instead slide along the land area and an unwanted additional length of tape will be dispensed.

DESCRIPTION OF THE INVENTION

The present invention provides for a tape dispenser of the type described above a simple and effective means for insuring that tape including a layer of pressure sensitive adhesive that affords low adhesion to adjacent coils and to a land area on the dispenser can be reliably pulled into engagement with the land area and cutter so that only a desired length of the tape will be dispensed, which means can be added without adding significantly to the material or assembly cost of the dispenser.

According to the present invention there is provided an improved tape dispenser of the type comprising a housing including a hub having a cylindrical peripheral surface, a roll of tape comprising a core having a through opening defined by a cylindrical inner surface journaled on the hub and a length of tape including a layer of pressure sensitive adhesive wound around the core and a paper backcard having a through opening and disposed around one end of the hub with the hub in the opening and a main portion of the backcard adjacent one side surface of the roll of tape; which improved dispenser is particularly useful for dispensing tape including a pressure sensitive adhesive which affords low adhesion between adjacent winds of the tape so that the tape is easily pulled from the roll.

In the improved tape dispenser according to the present invention, the backcard further comprises a plurality of projecting portions which have base edges joined to the main portion, and the backcard is bent at about a right angle along the base edges with the projecting portions projecting between the hub and the core to provide a friction brake therebetween restricting rotation of the hub to an extent that (1) will prevent unwanted rotation of the hub and uncoiling of the tape when it is being withdrawn from the dispenser and (2) will provide a tension in the tape being withdrawn that will help the user pull the tape into engagement with the land area and cutter to sever a dispensed length.

Preferably the projecting portions are generally triangular and are formed by making cuts radially outwardly from the center of the intended opening in the backcard and bending the triangular portions thus formed along their base edges by pressing the backcard over the hub after which the roll of tape is applied over the hub and triangular portions.

Depending on the spacing between the hub and the core, the thickness of the backcard, and the degree of braking desired, the entire intended opening may thus be formed into triangular portions (e.g., 8 identical triangular portions each having an apex angle of 45 degrees) or only some of the areas of the backcard in which the opening is to be formed may be formed into triangular portions.

When only some of the possible triangle portions are formed, those formed may be disposed side by side or with intervening spaces. It has been found that for the same number and size of triangular portions when only some are used, triangular portions side by side provide less braking action than the same number of the same sized triangles with spaces therebetween.

The backcard may also be notched or slit along the base edges of the triangular portions to facilitate bending the backcard at right angles along the base edges, which is particularly useful when the backcard with its main and projecting portions in the same plane is being pushed over the hub by automated equipment during assembly of the dispenser to bend the backcard along the base edges.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
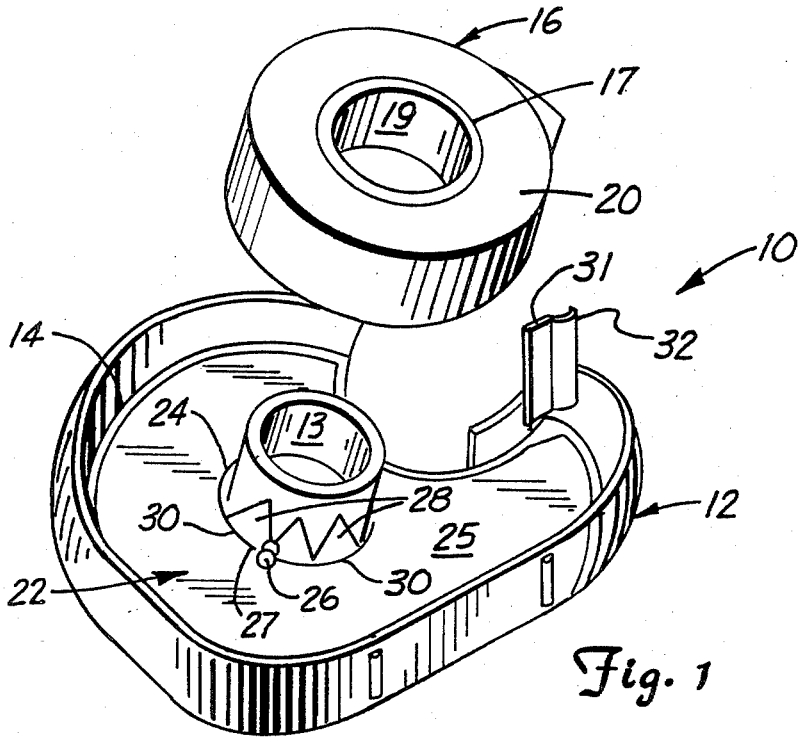
FIG. 1 is a partially exploded perspective view (in which one sidewall is not shown) of a first embodiment of an improved tape dispenser according to the present invention.

Referring now to FIG. 1 there is shown an improved tape dispenser according to the present invention, generally designated by the reference numeral 10.

The tape dispenser 10 comprises a housing 12 including a hub 13 having a cylindrical peripheral surface, with side walls 14 of the housing 12 (only one of which is shown) on opposite ends of the hub 13, a tape roll 16 comprising a core 17 having a through opening defined by a cylindrical inner surface 19 journaled on the hub 13, and a length of tape 20 including a backing and a layer of pressure sensitive adhesive wound around the core 17, with the layer of pressure sensitive adhesive included in the tape 20 affording low adhesion between adjacent winds of the tape 20 so that the tape 20 is easily pulled from the roll 16; and a paper backcard 22 having a through opening 24 and disposed around one end of the hub 13 with the hub 13 in the 24 opening and a main portion 25 of the backcard 22 adjacent one side surface of the tape roll 16 and fixed against rotation of the backcard 22 relative to the hub 13 by engagement of three spaced lugs 26 (only one of which is shown) projecting inwardly from the adjacent sidewall 14 of the housing 12 into openings 27 in the backcard 22.

The backcard 22 is cut from a planar sheet (FIG. 2) to further comprise a plurality of generally triangular projecting portions 28 having base edges 30 joined to the main portion 25 and is bent at about a right angle along the base edges 30 (FIG. 1) so that the triangular projecting portions 28 project between the hub 13 and the core 17 to provide a friction break therebetween restricting rotation of the hub 13 to an extent that will prevent unwanted rotation of the hub 13 and uncoiling of the tape 20 when it is withdrawn from the dispenser 11 and will provide a tension in the tape 20 being pulled from the roll of tape 16 that will help a person pull the layer of pressure sensitive adhesive of the tape 20 into engagement with a land area 31 and a cutter 32 on the housing 12 so that the tape 20 will be adhered to the land area 31 and the dispensed length of the tape 20 will be cut on a serrated edge of the cutter 32.

Figure 2:
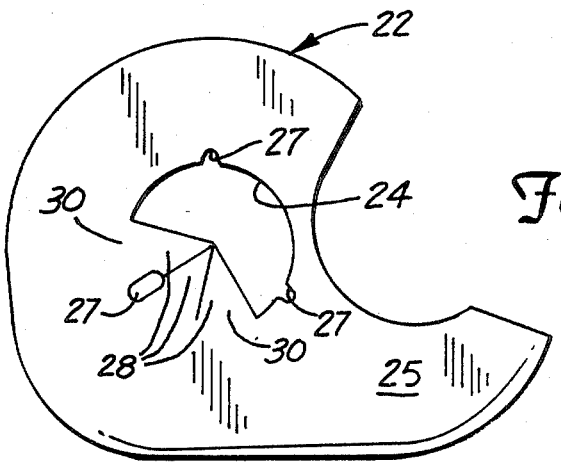
FIG. 2 is a plan view of a backcard used in the dispenser of FIG. 1 showing a main portion and several projecting portions of the backcard in the same plane.

As illustrated in FIGS. 1 and 2, the backcard 22 has three adjacent triangular projecting portions 28 each formed by linear cuts radially of the intended opening in which the hub is received, and each having an apex angle of about 45 degrees. This configuration has been found to work well when the hub 13 and core 17 are of a hard smooth polymer (e.g., styrene), the hub 13 has a diameter of about 2.545 centimeters (1.002 inches), the inner surface 19 of the core 17 has a diameter of about 2.606 centimeters (1.026 inches), and the backcard 22 is of paper board having a thickness of about 0.025 centimeter (0.010 inch).

The dispenser 10 is particularly useful when the layer of pressure sensitive adhesive included in the tape 20 is adhered to one side of the backing in such a way that a length of the tape 20 can be removed from the dispenser 10, the layer of adhesive can be adhered to a first substrate, and the backing can then be peeled away so that a second substrate can be adhered to the layer of pressure sensitive adhesive on its side opposite the first substrate (e.g., the tape designated Cat. 109 "Wallsaver" TM Removable Mounting Tape to be sold by Minnesota Mining and Manufacturing Company after Sept. 1, 1986). The backing in on such tape 20 must have an outer surface that the layer of pressure sensitive adhesive on an outer coil of the tape 20 will not easily adhere to, or that layer of pressure sensitive adhesive may transfer to the wrong side of the backing in the roll 16. Thus the surface of the backing opposite the layer of pressure sensitive adhesive is treated in a known manner to lower adhesion by even an already low tack adhesive, so that without the brake means provided by the projecting portions 28, the tape 20 in the roll 16 is very easily unrolled.

Figure 3:
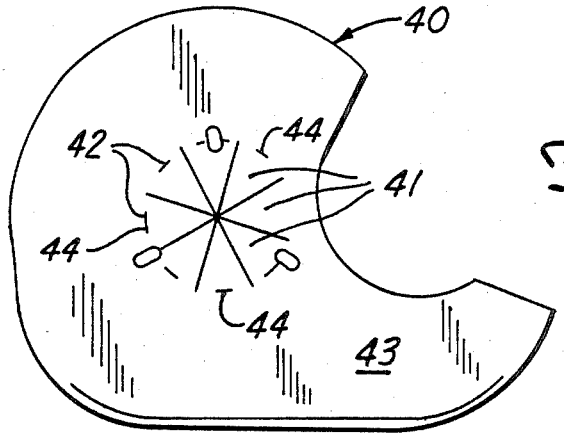
FIGS. 3 and 4 illustrate alternate embodiments of backcards that could be substituted for the backcard used in the dispenser of FIG. 1 also shown with main portion and several projecting portions of the backcards in the same plane.

Referring now to FIG. 3 there is shown a first alternate embodiment of a backcard that can be used in the dispenser 10 and is designated by the reference numeral 40. The backcard 40 comprises a plurality of generally triangular projecting portions 41 having base edges 42 joined to a main portion 43 thereof, which backcard 40 can be bent at about a right angle along the base edges 42 of the triangular projecting portions 41 so that the triangular portions 41 can project between the hub 13 and the core 17 in the dispenser 10 to provide a friction brake therebetween restricting rotation of the hub 13 in the manner of the triangular projecting portions 28 shown in FIGS. 1 and 2.

The backcard 40 shown in FIG. 3 differs from the backcard 22 shown in FIGS. 1 and 2 in that the backcard 40 has eight adjacent triangular projecting portions 41 each formed by linear cuts radially of the intended opening in which the hub 13 can be received, and each having an apex angle of about 45 degrees. Also, each of the triangular projecting portions 41 has a slit 44 centrally along its base edge 42 which facilitates bending the backcard 40 along the base edges 42 of the triangular projecting portions 41 to afford positioning the triangular portions 41 between the hub 13 and the core 17 to provide a friction brake therebetween to provide the advantages previously described. Slits similar to the slits 44 are preferably also provided on the backcard 22 described with reference to FIGS. 1 and 2 centrally along the base edges 30 when that backcard 22 is to be applied around the hub 13 by automated machinery.

Figure 4:
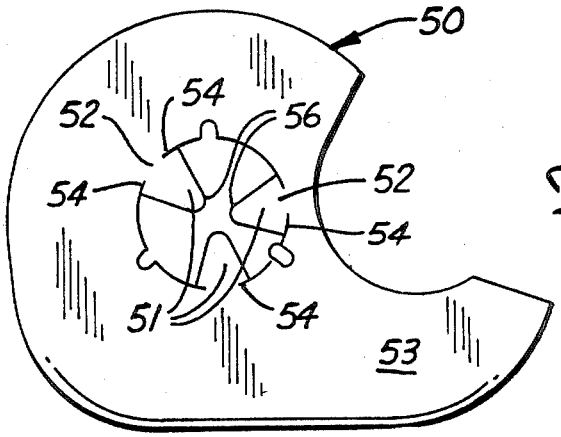

Referring now to FIG. 4 there is shown a second alternate embodiment of a backcard that can be used in the dispenser 10 and is designated by the reference numeral 50. The backcard 50 comprises a plurality of generally triangular projecting portions 51 having base edges 52 joined to a main portion 53 thereof, which backcard 50 can be bent at about a right angle along the base edges 52 of the triangular projecting portions 51 so that the triangular projecting portions 51 can project between the hub 13 and the core 17 in the dispenser 10 to provide a friction brake therebetween restricting rotation of the hub 13 in the manner of the triangular projecting portions 28 shown in FIGS. 1 and 2.

The backcard 50 shown in FIG. 4 differs from the backcard 22 shown in FIGS. 1 and 2 in that the backcard 50 has three generally triangular projecting portions 51 each partially formed by linear cuts radially of the intended opening in which the hub 13 can be received, and each having an apex angle of about 45 degrees, which projecting portions 51 are spaced apart. The projecting portions 51 have radiused tips 56 which may facilitate pressing the core 17 over the hub 13 and the projecting portions 51. Also each of the projecting portions 51 has a slit 54 at each end of its base edge 52 which facilitates bending the backcard 50 along the base edges 52 of the projecting portions 51 to afford positioning the triangular portions 40 between the hub 13 and the core 17 to provide a friction brake therebetween and provide the advantages previously described.

The present invention has now been described with reference to several embodiments thereof. It will be apparent to those skilled in the art that many changes can be made in the embodiments described without departing from the scope of the present invention. For example, various numbers of projecting portions may be needed depending on the material and dimensions of the hub, core and backcard in a given dispenser. Also, the projections need not be generally triangular, but could, for example, be semicylindrical, generally rectangular, etc. Thus the scope of the present invention should not be limited to the structures described in this application, but only by structures described by the language of the claims and the equivalents of those structures.

We claim:

1. A tape dispenser comprising a housing including a hub having a cylindrical peripheral surface, a roll of tape comprising a core having a through opening defined by a cylindrical inner surface journaled on said hub and a length of pressure sensitive adhesive coated tape wound around said core with said adhesive affording low adhesion between adjacent winds of the tape so that the tape can be easily pulled from the roll; and a backcard having a through opening and disposed around one end of said hub with said hub in said opening and a main portion of the backcard adjacent one side surface of said roll of tape, said backcard further comprising a plurality of projecting portions having base edges joined to said main portion and bent at about a right angle along said base edges with said projecting portions projecting between said hub and said core to provide a friction brake therebetween that will restrict rotation of said hub to an extent that will prevent unwanted rotation of the hub and uncoiling of the tape when it is withdrawn from the dispenser.

2. A dispenser according to claim 1 wherein said backcard comprises three adjacent projecting portions.

3. A dispenser according to claim 1 wherein said projecting portions are generally triangular.

4. A dispenser according to claim 3 wherein said generally triangular projecting portions have radiused tips and said backcard is slit centrally along said base edges.

* * * * *